United States Patent [19]

Meurer

[11] Patent Number: 4,743,020

[45] Date of Patent: May 10, 1988

[54] BALL RETURN AND TARGET DEVICE

[76] Inventor: Julius Meurer, Kuhmarkt 16, 2848 Vechta, Fed. Rep. of Germany

[21] Appl. No.: 889,820

[22] Filed: Jul. 24, 1986

[30] Foreign Application Priority Data

Jul. 27, 1985 [DE] Fed. Rep. of Germany ..... 3526956

[51] Int. Cl.[4] ..... A63B 69/40

[52] U.S. Cl. ..... 273/29 A; 273/182 R; 273/26 A; 273/395

[58] Field of Search ..... 273/30, 29 A, 26 A, 273/181 A, 407, 398, 410, 181 S, 181 K, 182 R, 317, 333, 348, 386, 389, 402, 395

[56] References Cited

U.S. PATENT DOCUMENTS

| | | | |
|---|---|---|---|
| 2,179,471 | 11/1939 | Lee | 273/407 |
| 2,482,234 | 9/1949 | Baker | 273/395 |
| 2,944,816 | 7/1960 | Dixon | 273/181 F |
| 3,231,280 | 1/1966 | Collins | 273/182 R |
| 3,511,503 | 5/1970 | Volpe | 273/395 |
| 3,511,506 | 5/1970 | Schollick | 273/182 R |
| 3,741,549 | 6/1973 | Wilson | 273/181 A |
| 3,810,616 | 5/1974 | Murphy | 273/181 A |
| 3,895,809 | 7/1975 | Shockley | 273/182 R |
| 4,497,485 | 2/1985 | Macosko | 273/407 |
| 4,625,974 | 12/1986 | Andrews | 273/407 |

*Primary Examiner*—Richard C. Pinkham
*Assistant Examiner*—T. Brown
*Attorney, Agent, or Firm*—Collard, Roe & Galgano

[57] ABSTRACT

A ball-game device comprising a baffle wall arranged on a transportable stand is characterized by the fact that the baffle wall has a front surface designed in the shape of a spherical indentation, and there is provided a frame. The frame surrounds the baffle wall and is supported on the stand. The baffle wall is, in turn, supported on the frame by means of at least one flexible fastening element.

11 Claims, 2 Drawing Sheets

1
2
6
3
9
7
10
8
4a
11
6
2
4c 6
6
8
7
3
2
1
4b
4a
4c

BALL RETURN AND TARGET DEVICE

BACKGROUND OF THE INVENTION

The invention relates to a device for ball-games with a baffle wall arranged on a transportable stand.

A device of the above type is disclosed in U.S. Pat. No. 2,021,989. The device has a board-like baffle plate or wall and the device may be used, for example, by an individual player for practicing tennis and squash. This known device, however, has the drawback that the player has to play the ball against the baffle plate at a relatively steep angle for the ball to be reflected at an angle of reflection which still permits the player to reach the ball for the next return. This means that the player can effectively make use of only a relatively limited surface area of the baffle plate from which the ball is reflected at the desired angle, as a result of which the player is required to hit the baffle plate with an accuracy which, as a practicable manner, the player is unable to obtain when smoothly repeating ball-hitting exercises. Furthermore, when the ball is forcefully hit by the player, the ball is reflected by the baffle plate at a speed which does not permit the player to react quickly enough to change from one hitting position to another and return the reflected ball. The consequence of these unfavorable properties of the known device is that the player is lucky if he or she simply manages to reach the reflected ball for playing it back against the baffle plate. As a result, however, the player is unable to concentrate on defined playing techniques which he or she may want to practice.

Accordingly, it is an object of the invention to provide a device of the above-stated type which affords improved playing properties.

SUMMARY OF THE INVENTION

According to the invention, this object is achieved by the provision of a baffle wall having a front surface designed in the form of a spherical indentation and a frame surrounding the baffle wall and being supported on a stand with the baffle wall being secured on the frame by means of at least one flexible fastening element.

The front surface of the baffle wall which, according to the invention, is designed in the shape of a spherical indentation, has particularly advantageous reflection properties and thus advantageous playing properties. If a ball is hit by a player from a standing or position line that is spaced from the baffle wall with a distance approximately conforming to the radius of the spherical curvature of the spherical indentation, and played against the baffle wall from this position, the ball, in its path of reflection, passes through a defined focal point. The focal point is the same irrespective of which area of the front surface of the baffle wall the ball hits, and irrespective of the angle at which the player is positioned relative to the front surface of the baffle wall. For this reason, the player will always exactly know at which point he has to expect the reflected ball for hitting it back against the wall. Even two players can play the ball to each other in an advantageous manner if one of the players positions himself within the zone of the focal point through which the ball passes after having been hit by the other player. Thus, the device of the invention assures precise playing and serving without requiring the player to accurately hit a defined area of the front surface of the baffle wall. This, in turn, allows the player to concentrate on ball-hitting techniques and makes use of the total front surface of the baffle wall.

The flexible fastening element supporting the baffle wall on the frame advantageously ensures that the baffle wall yields when hit by a ball due to the resilience of the flexible fastening element, and then returns to its resting position. The harder the ball is hit, the more the speed of the ball is decelerated by the yielding baffle wall before it is reflected, so that advantageously, the speed of the reflected ball is moderate even when hit hard, permitting the player to comfortably hit the ball again and return it against the wall. The return of the baffle wall to its resting position after yielding and damping of the speed of the ball are partly caused by the resistance of the air behind the baffle wall in that this air is slightly compressed when the baffle wall is yielding. Preferably, the baffle wall itself is non-yielding and resistant to bending.

In a preferred embodiment of the device of the invention, several fastening elements are provided for suspending the baffle wall in the frame. The fastening elements are arranged along the edge of the frame in a spaced-apart manner and the baffle wall is provided with a clearance, relative to the frame, for yielding when hit by a ball in a particularly advantageous manner. Thus, the frame does not interfere with any movement of the baffle wall since the baffle wall is suspended from the frame in such a manner that it cannot strike the frame.

According to a further preferred embodiment, the fastening elements are elastically resilient, preferably in the form of strips of rubber, so that the fastening elements as such, afford resetting and damping forces acting on the baffle wall when the latter is deflected, as well.

Desirably, the radius of the curvature of the spherical indentation is about 6 to 8 meters, preferably 7 meters, and the diameter of the circular outer edge of the spherical indentation amounts to about 2 meters. For playing the ball, the best distance from the baffle wall conforms to approximately the radius of the spherical curvature. Under normal tennis and squash playing conditions, the distance from the baffle wall for playing the ball is about 7 meters. From this distance, even inexperienced players can easily hit the spherical indentation, which has an area diameter of 2 meters, and the latter is small enough to be transported by the player through house doors or the like.

Preferably, glass fiber-reinforced polyester resin is used as the material for the baffle wall. The playing properties of this material are especially favorable; furthermore, this material is inexpensive and it can be processed in a simple way.

So that the baffle wall may be adjusted to the size of the player and high or low balls may be selectively practiced, the playing properties of the device of the invention are enhanced further by another feature of the invention—namely, by the feature that the baffle wall may be adjusted in its inclination relative to the vertical.

Preferably, the stand is a tripod whose legs approximately form a tetrahedron, wherein two legs are connected with each other by the frame of the baffle wall and the third leg is designed in such a way that its length can be varied relative to the inclination of the baffle wall.

Alternatively or in addition to the third leg, whose length may be changed, the device of the invention may have a joint by way of which the legs of the tripod are connected with each other at their top ends. In this way, too, the inclination of the baffle wall can be adjusted and the stand is foldable in an advantageous manner as well.

Other objects and features of the present invention will become apparent from the following detailed description considered in connection with the accompanying drawings. It is to be understood, however, that the drawings are designed as an illustration only and not as a definition of the limits of the invention.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figures 1, 2:
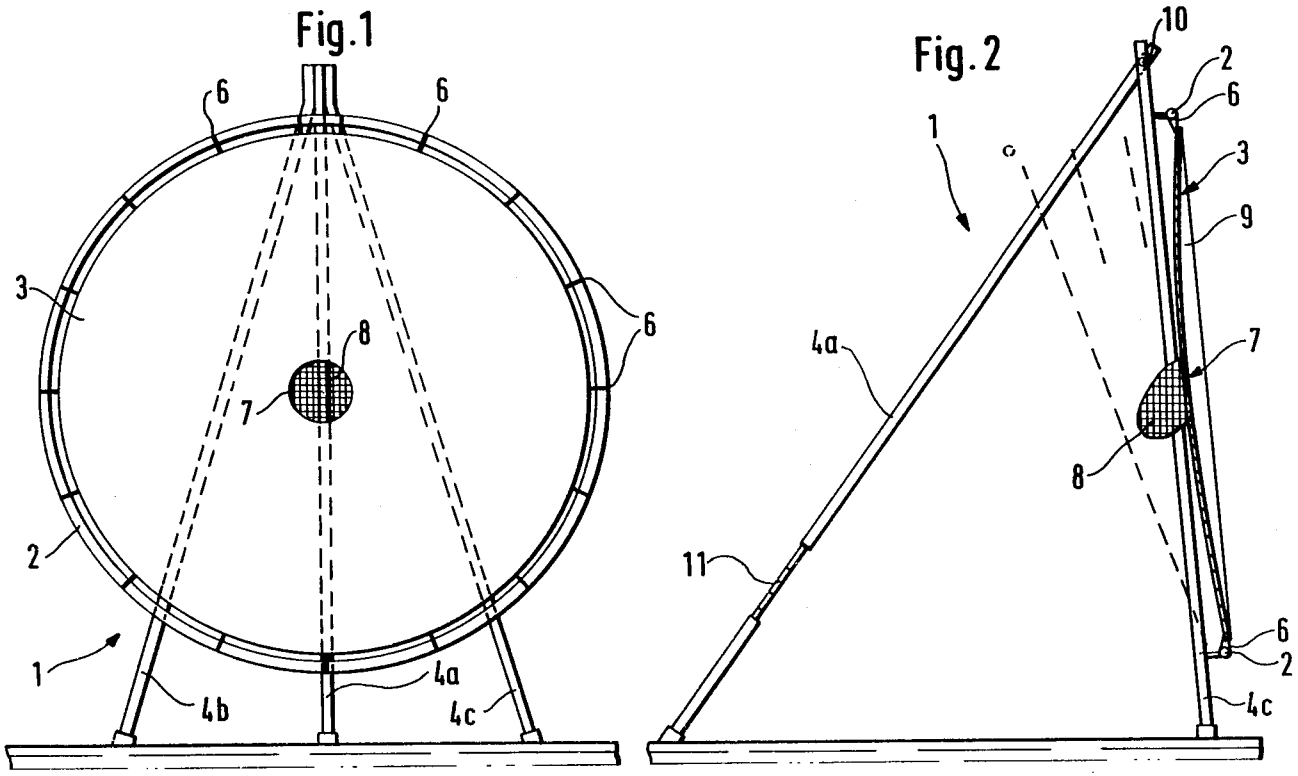
FIG. 1 is a front elevational view of a device embodying the present invention.
FIG. 2 is a side elevational view, in part section, of the device shown in FIG. 1.

Referring now in detail to FIG. 1, therein illustrated is a device embodying the present invention which has a stand 1 on which is mounted an annular, tubular frame 2 which, in turn, supports a baffle plate or wall 3. Stand 1 is provided in the form of a tetrahedron-like tripod. Frame 2 is arranged on the two legs **4*b*, 4*c* of the tripod, with the third leg 4*a* of the tripod supporting the other legs 4*b* and 4*c* and frame 2** arranged thereon at a predetermined angle of inclination relative to the vertical.

Frame 2 and the baffle wall or plate 3 supported on frame 2 have a circular contour and the baffle plate 3 is elastically suspended on frame 2 by means of a plurality of fastening elements 6, the latter being arranged along the edge of plate 3 in an evenly spaced apart manner. Fastening elements 6 are strips of rubber arranged on the edge of the baffle plate 3 and looped around frame 2.

In the center of baffle plate 3, a ball opening 7 is provided, through which the ball can be played. In order to prevent the ball from getting lost, a ball catcher 8 is arranged behind the ball opening 7 which consists of a net stretched across the ball opening 7.

As seen best in FIG. 2, in which the baffle plate 3 is shown in longitudinal sectional view, the front surface 9 of the baffle plate or wall 3 has a concave shape in the form of a spherical indentation. It is shown, furthermore, that the two front legs **4*b*, 4*c*, of the tripod are connected with the third, rearward leg 4*a* of the tripod by way of a joint 10, which permits stand 1 to be folded and permits adjustment of the angle of inclination of the baffle plate 3 relative to the vertical. For adjusting the angle of inclination of the baffle plate 3, the rear leg 4*a* of the tripod has an extension segment 11, which can be pushed in and out. This segment is equipped with locking elements (not shown) for fixing the segment in its extended position, and which segment permits changing the angle of tilt or inclination of the baffle plate 3 even when the angle between the front legs 4*b*, 4*c* and the rear leg 4*a* of the tripod is constant. So as to prevent the three legs 4*a*, 4*b* and 4*c* of the stand 1 from coming apart, the front legs 4*b*, 4*c* of the stand 1 may be provided with connecting elements, strips, chains, rods or the like for connecting the front legs with the rear leg, with the connecting elements being adjustable to the angular position of the joint 10**.

Figure 3:
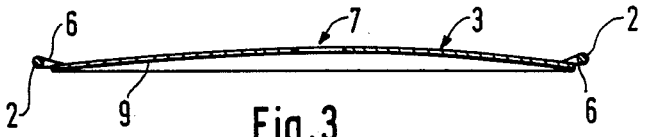
FIG. 3 is a sectional view of the device shown in FIGS. 1 and 2.

FIG. 3 shows a cross-sectional view of the baffle plate 3 with the frame 2, but without stand 1 and without ball-catching device 8, in order to clearly show the special spatial shape of a spherical indentation in the front surface 9 of baffle plate 3. The baffle plate or wall 3 is schematically shown in FIG. 4 and is the same as the one shown in FIG. 3; the arc 12 clearly shows that the baffle wall or plate 3 has the shape of a spherical calotte.

The dashed lines are examples of the ball trajectories 13, showing the path of flight which a ball, for example, a tennis ball, would follow if hit at point 14 in the direction of the outer edges of baffle wall 3. FIG. 4 shows that irrespective of the ball trajectory 13, the ball is reflected on the baffle wall 3 according to the reflection law (i.e., angle of incidence=angle of emergence, provided the ball is not spinning) and passes through a focal point 15 in which all ball trajectories 13 come together. This shows that the device of the invention is particularly suitable for two players as well, standing on opposite sides of the center area normal line 16 of the baffle wall 3 and playing the ball to each other because the ball, irrespective of the hitting angle, is flying through a focal point, for example, focal point 15, which point depends on the distance of the player from the baffle wall 3; this means that the focal point can be calculated by the players.

Figure 4:
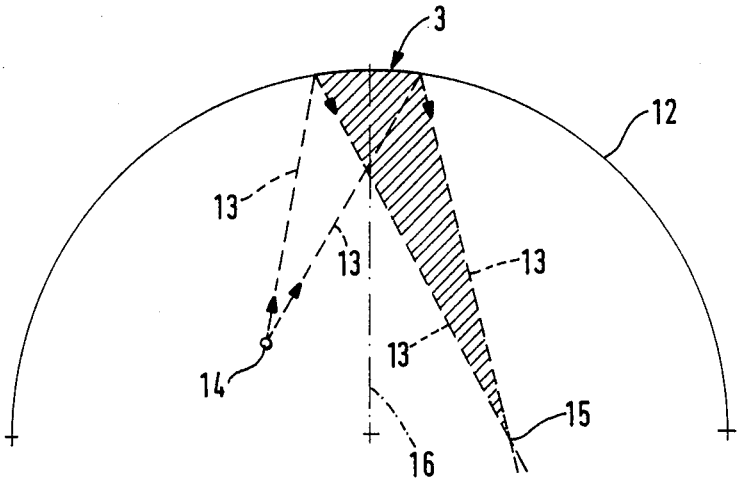
FIG. 4 is a schematic top view showing the ball trajectories when using the device according to the preceding figures.
Figure 5:
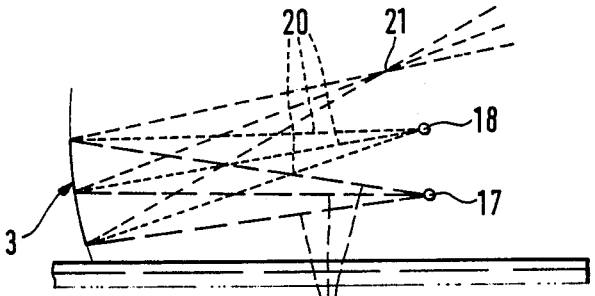
FIG. 5 is a schematic lateral view of the ball trajectories.

FIG. 5 shows a pattern similar to the one in FIG. 4, but in a lateral view. In the present example, the baffle wall has an angle of inclination of 10 degrees relative to the vertical. FIG. 5 shows that irrespective of whether a ball is hit from a lower hitting point 17 or a higher hitting point 18, the ball will follow the ball trajectories 19, 20, which intersect each other in a focal point 21, so that the altitude of the returned ball may be calculated or estimated as well.

While only a single embodiment of the present invention has been shown and described, it will be obvious that many changes and modifications may be made thereunto without departing from the spirit and scope of the invention.

What is claimed is:

1. A ball-game device, comprising:

a stand;

a frame supported on said stand; and a baffle wall made of non-yielding material for reflecting a ball surrounded by said frame and supported thereon by at least one flexible fastening element, said baffle wall having a concave front surface in the form of a spherical indentation, said fastening element permitting yielding of said baffle wall with respect to said frame upon impact by said ball and then returning said baffle to its resting position.

2. The device of claim 1, wherein a plurality of said fastening elements are provided along said frame in an evenly spaced-apart manner, by means of which elements said baffle wall is suspended in said frame.

3. The device of claim 2, wherein said fastening elements are elastically resilient.

4. The device of claim 3, wherein said fastening elements are in the form of rubber strips.

5. The device of claim 1, wherein the radius of the curvature of said spherical indentation amounts to about 6 to 8 meters, and that the diameter of the circular outer edge of said spherical indentation comes to about 2 meters.

6. The device of claim 5, wherein the radius of the curvature of said spherical indentation amounts to about 7 meters.

7. The device of claim 1, wherein said baffle wall is made of glass fiber-reinforced polyester resin.

8. The device of claim 1, additionally including means for adjusting the inclination of said baffle wall relative to the vertical.

9. The device of claim 8, wherein said stand is a tripod having three legs approximately forming a tetrahedron, the first two legs of which are connected with each other by said frame, and the third leg of which defines at least in part said means for adjusting and is variable lengthwise relative to the adjustment of the inclination of said baffle wall.

10. The device of claim 9, wherein said tripod legs have top ends and wherein said tripod has a joint which connects said legs of said tripod with each other at their top ends.

11. The device of claim 1, wherein said baffle wall includes a centrally-located ball opening.

* * * * *